US008080928B2

(12) United States Patent
Hiroki et al.

(10) Patent No.: US 8,080,928 B2
(45) Date of Patent: Dec. 20, 2011

(54) ELECTRON-EMITTING DEVICE AND IMAGE DISPLAY APPARATUS USING THE SAME

(75) Inventors: Tamayo Hiroki, Zama (JP); Hisanobu Azuma, Hadano (JP); Jun Iba, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 603 days.

(21) Appl. No.: 12/209,616

(22) Filed: Sep. 12, 2008

(65) Prior Publication Data

US 2009/0072697 A1 Mar. 19, 2009

(30) Foreign Application Priority Data

Sep. 19, 2007 (JP) ..... 2007-242109

(51) Int. Cl.
*H01J 1/30* (2006.01)
*H01J 1/62* (2006.01)

(52) U.S. Cl. ..... 313/310; 313/495; 313/497

(58) Field of Classification Search ..... 313/509, 313/309–310, 495–497
See application file for complete search history.

(56) References Cited

U.S. PATENT DOCUMENTS

| | | | | |
|---|---|---|---|---|
| 5,861,227 | A * | 1/1999 | Ikeda et al. | 430/31 |
| 6,306,001 | B1 | 10/2001 | Hiroki | 445/6 |
| 6,626,718 | B2 | 9/2003 | Hiroki | 445/6 |
| 6,703,791 | B2 | 3/2004 | Azuma | 315/169.3 |
| 6,972,203 | B2 | 12/2005 | Azuma | 438/20 |
| 7,151,005 | B2 | 12/2006 | Azuma | 438/20 |
| 7,381,578 | B2 | 6/2008 | Azuma | 438/20 |
| 7,382,088 | B2 | 6/2008 | Azuma et al. | 313/495 |
| 7,427,826 | B2 | 9/2008 | Iba et al. | 313/236 |
| 7,427,830 | B2 | 9/2008 | Taniguchi et al. | 313/495 |
| 2006/0063459 | A1 | 3/2006 | Iba et al. | 445/3 |
| 2006/0087220 | A1 | 4/2006 | Hiroki et al. | 313/495 |

FOREIGN PATENT DOCUMENTS

| | | |
|---|---|---|
| JP | 08-102251 | 4/1996 |
| JP | 2006-066335 | 3/2006 |

OTHER PUBLICATIONS

Machine translation of JP 2006-66335.*

* cited by examiner

*Primary Examiner* — Nimeshkumar Patel
*Assistant Examiner* — Anthony Perry
(74) *Attorney, Agent, or Firm* — Fitzpatrick, Cella, Harper & Scinto

(57) ABSTRACT

A convex portion 2 having a specific sectional shape is formed on a substrate 1 between electrodes 3 and 4, and a gap 6 is formed on a conductive film 5, connecting the electrodes 3 and 4, on the convex portion 2, whereby the distance from the center of the gap 6 serving as a electron-emitting portion to the stagnation point is reduced so as to enhance an electron emission efficiency.

5 Claims, 8 Drawing Sheets

ELECTRON-EMITTING DEVICE AND IMAGE DISPLAY APPARATUS USING THE SAME

BACKGROUND OF THE INVENTION

1. Field of the Invention

The present invention relates to an electron-emitting device adapted to a flat panel display and an image display apparatus using the electron-emitting device.

2. Description of the Related Art

A surface conduction electron-emitting device utilizes a phenomenon in which an electron emission is produced by flowing an electric current to a conductive film, which is formed on a substrate and has a small area, in parallel to the surface of the film. An electron-emitting portion is generally formed on the conductive film with an energizing process (forming) beforehand. Specifically, DC voltage or boosted voltage, which is boosted very slowly, such as in 1 V/min., is applied to the both ends of the conductive film, so as to locally destroy, deform or transubstantiate the conductive film, whereby an electron-emitting portion that is in electrically high-resistive state is formed. At the electron-emitting portion, a gap is formed at a part of the conductive film, so that electrons are emitted from the vicinity of the gap.

Japanese Patent Application Laid-Open (JP-A) No. H08 (1996)-102251 discloses a technique in which a height regulating member having a sharp projecting shape is formed on a substrate, and a conductive film is formed thereon, in order to reduce electric power upon forming a gap.

JP-A No. 2006-66335 discloses an electron-emitting device having an electron-emitting portion on a convex surface.

SUMMARY OF THE INVENTION

According to the technique disclosed in JP-A No. H08 (1996)-102251, an electric field can locally be increased upon the forming due to the sharp structure. However, the electron emission efficiency might greatly vary due to a slight positional deviation of the formed gap, with the result that control means for the position of the gap should be needed. In this technique, the effect of enhancing the electron emission efficiency of the electron-emitting device is small.

An object of the present invention is to enhance an electron emission efficiency without increasing a variation in the electron emission efficiency in an electron-emitting device that emits electrons from the vicinity of a gap formed on a conductive film.

The first aspect of the present invention is an electron-emitting device including a substantially linear convex portion forming a projection on a substrate; a first electrode and a second electrode formed on the substrate across the convex portion; a conductive film that connects the first electrode and the second electrode; and an electron-emitting portion that is composed of a gap formed on the conductive film and is present on the convex portion, wherein, supposing that a direction in which the convex portion extends is defined as a Y direction, a direction orthogonal to the Y direction on the substrate is defined as an X direction, and a normal direction of the substrate is defined as a Z direction, a top portion of the convex portion in X-Z section has a curved portion having a convex shape toward the projecting direction of the convex portion, and supposing that a voltage applied between the first electrode and the second electrode upon a electron emission is defined as Vf, a distance between an anode electrode, which is opposite to the substrate, and the substrate is defined as L, a voltage applied between the substrate and the anode electrode is defined as Va, a height from a surface of the substrate to the top of the convex portion is defined as H, a width of the convex portion at a bottom surface in the X direction is defined as W, and a distance between a center of the gap in the X direction and the top of the convex portion is defined as Xg, $$H \geqq (Vf \times L)/(\pi \times Va)$$

$$|Xg| \leqq 0.35\ W$$

are established.

The present invention includes, as a preferable embodiment, that a radius of curvature of the curved portion at the top is not less than 0.5 W.

The second aspect of the present invention is an electron-emitting device including a substantially linear convex portion forming a projection on a substrate; a first electrode and a second electrode formed on the substrate across the convex portion; a conductive film that connects the first electrode and the second electrode; and an electron-emitting portion that is composed of a gap formed on the conductive film and is present on the convex portion, wherein, supposing that a direction in which the convex portion extends is defined as a Y direction, a direction orthogonal to the Y direction on the substrate is defined as an X direction, and a normal direction of the substrate is defined as a Z direction, a top portion of the convex portion in X-Z section has a plane portion whose width in the X direction is Wt, and a curved portion that is in contact with the plane portion and projects outwardly, and supposing that a voltage applied between the first electrode and the second electrode upon the electron emission is defined as Vf, a distance between an anode electrode, which is opposite to the substrate, and the substrate is defined as L, a voltage applied between the substrate and the anode electrode is defined as Va, a height from a surface of the substrate to the top of the convex portion is defined as H, a width of the convex portion at a bottom surface in the X direction is defined as W, and a distance between a center of the gap in the X direction and the top of the convex portion is defined as Xg, $$H \geqq (Vf \times L)/(\pi \times Va)$$

$$|Xg| \leqq 0.35\ W + 0.14\ Wt$$

are established.

The present invention is also configured as an image display apparatus including a first substrate having plural electron-emitting devices according to the first aspect or the second aspect of the present invention; and a second substrate having an image forming member that emits light by the electrons emitted from an anode electrode, which is opposite to the substrate, and the electron-emitting devices.

In the present invention, the convex portion having a specific shape is formed on the substrate, and the gap is formed on the conductive film on the convex portion, whereby an electric field in which electrons are accelerated toward the anode electrode is multiplied, resulting in that the electron emission efficiency is enhanced. Since the multiplication of the electric field at the top of the convex portion is uniform, the variation in the electron emission efficiency is small. Accordingly, the present invention provides an image display apparatus that can display a high-quality image by plural electron-emitting devices having uniform electron emission efficiency.

Further features of the present invention will become apparent from the following description of exemplary embodiments with reference to the attached drawings.

BRIEF DESCRIPTION OF THE DRAWINGS

FIG. 1 is a view schematically showing a configuration of one embodiment of a first electron-emitting device according to the present invention, wherein

FIG. 5 is a view showing an example of a shape of a convex portion of the electron-emitting device according to the present invention, wherein

DESCRIPTION OF THE EMBODIMENTS

An electron-emitting device according to the present invention is formed on a substrate. An anode electrode is arranged with a distance L from the surface of the substrate. The electron-emitting device according to the present invention includes a first electrode and a second electrode arranged on the substrate with a space and a conductive film that connects the first and second electrodes, wherein a gap is formed on the conductive film so as to emit electrons. For example, a surface conduction electron-emitting device is a preferable embodiment to which the present invention is applied.

The feature of the present invention is that a convex portion having a specific sectional shape is formed on the surface of the substrate between the pair of electrodes. In the first invention, the top of the convex portion is a curved portion projecting outwardly, while in the second invention, the top of the convex portion is composed of a plane portion and a curved portion that is continuous with the plane portion and projects outwardly.

A preferable embodiment of the present invention will be specifically explained below, taking a surface conduction electron-emitting device as an example.

Figure 1A:
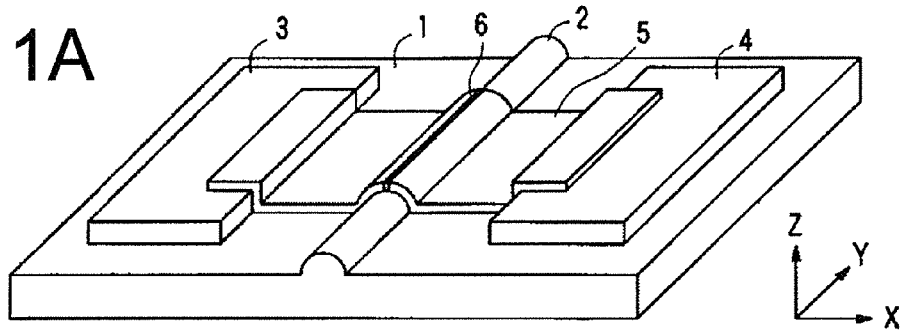
FIG. 1A is a perspective view.
Figure 1B:
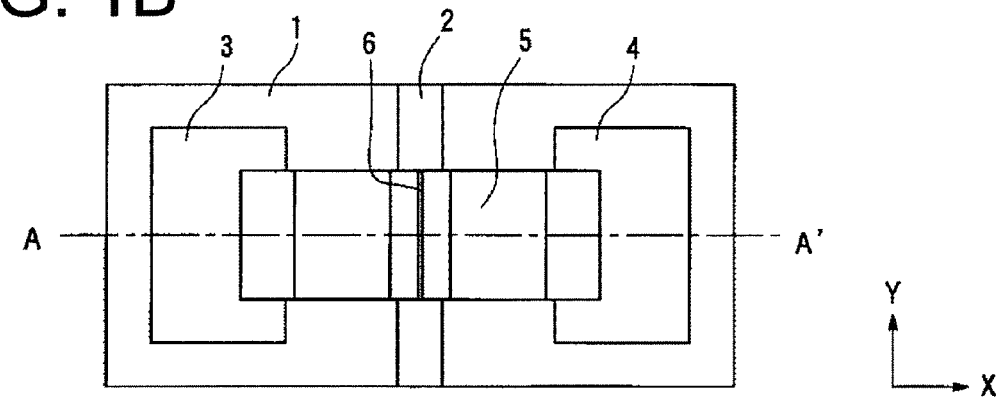
FIG. 1B is a plan view.
Figure 1C:
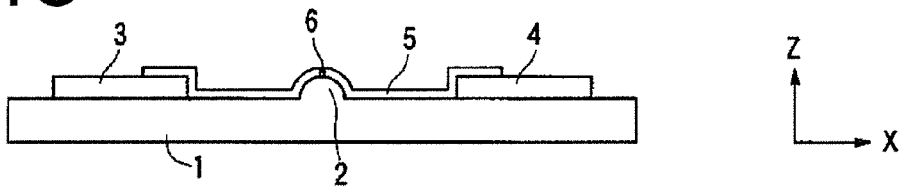
FIG. 1C is a sectional view.

FIG. 1 is a view schematically showing a configuration of one embodiment of the first electron-emitting device according to the present invention, wherein FIG. 1A is a perspective view, FIG. 1B is a plan view, and FIG. 1C is a sectional view along a line A-A' in FIG. 1E.

As shown in FIG. 1, the electron-emitting device according to the present invention includes a pair of electrodes 3 and 4 and a conductive film 5 that connects the electrodes 3 and 4. A gap 6 is formed on the conductive film 5.

In the present invention, the direction parallel to the surface of the substrate 1 and parallel to the opposite end sides of the electrodes 3 and 4 is defined as a Y direction, the direction parallel to the surface of the substrate 1 and orthogonal to the Y direction is defined as an X direction, and the normal direction of the surface of the substrate 1 is defined as a Z direction.

Figure 2A:
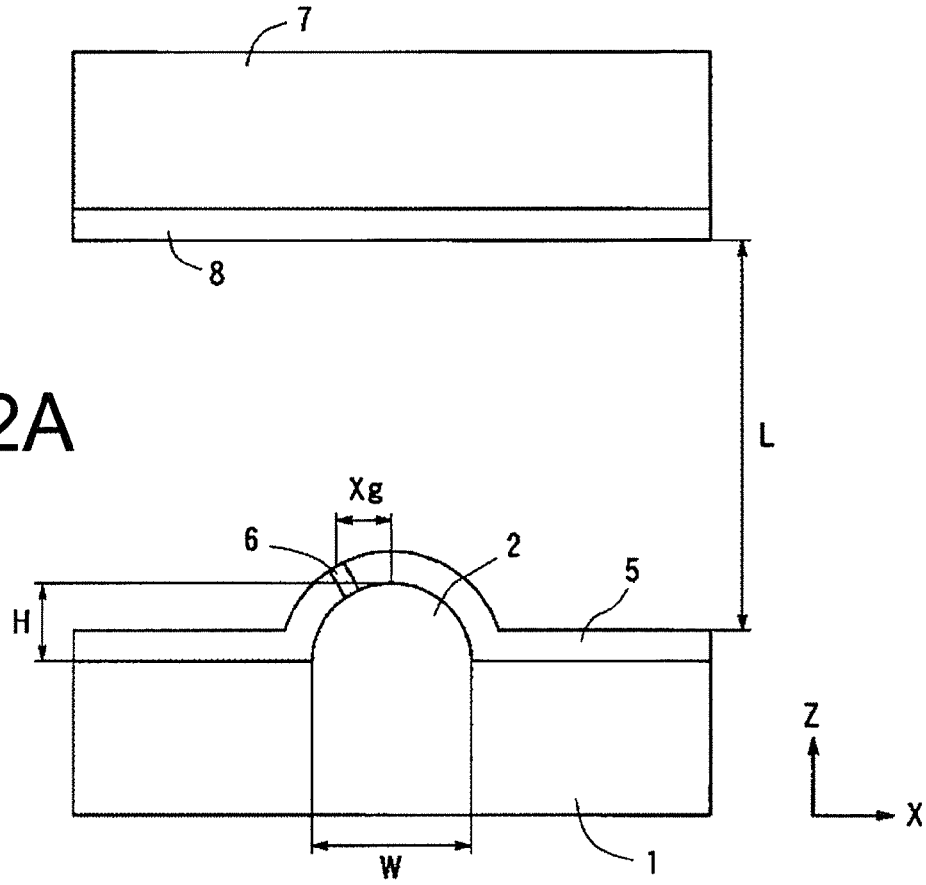
FIG. 2A is a sectional view of the electron-emitting device shown in FIG. 1.
Figure 2B:
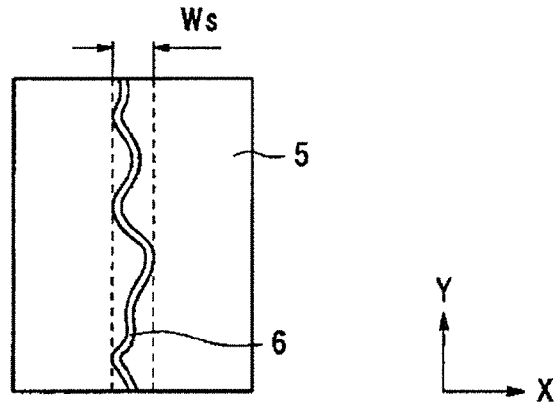
FIG. 2B is a partially enlarged plan view of a gap 6.

FIG. 2A is a partial enlarged view of the vicinity of the gap 6 of the electron-emitting device in the present embodiment, and is a schematic sectional view corresponding to the sectional portion along A-A' in FIG. 1B. In the figure, numeral 7 denotes a counter substrate, and numeral 8 denotes an anode electrode. FIG. 2B is a partially enlarged plan view of the gap 6.

In the present invention, the anode electrode 8 is arranged with a distance L from the surface of the substrate so as to be opposite to the electron-emitting device. The device emits electrons from the vicinity of the gap 6 when a voltage Vf is applied between the first electrode 3 and the second electrode, and a voltage Va is applied between the conductive film 5 and the anode electrode.

The feature of the present invention is that a convex portion 2 is formed on the surface of the substrate 1, and the gap 6 is formed on the conductive film 5 on the convex portion 2. As shown in FIG. 2A, the height from the surface of the substrate 1 to the top of the convex portion 2 is defined as H, the width of the convex portion 2 at the bottom surface in the X direction is defined as W, and the distance between the center of the gap 6 in the X direction and the top of the convex portion 2 is defined as Xg. In the present invention, the top of the convex portion 2 means, in the first invention, the highest position of the top at the section in the X-Z plane, and in the second invention, the center of the plane portion of the top at the section in the X-Z plane. When the convex portion 2 is formed by digging the surface of the substrate 1, the most deeply dug surface is defined as the surface of the substrate that is the basis of the height H. The width W of the bottom surface of the convex portion 2 is specifically the width in the X direction at the region of 1% of the height H of the convex portion 2.

The convex portion 2 in the present invention is a substantially linear portion extending in the Y direction. However, when the aforesaid H, W, Xg and Y are not uniform at each point in the Y direction, the convex portion is specified by the average values of them.

The gap 6 formed on the conductive firm 5 is formed along the Y direction as serpentining within the width Ws.

Each component of the electron-emitting device according to the present invention will be described below.

A glass (quartz glass, glass in which an impurity content such as Na is reduced, soda-lime glass) can be used as the substrate 1. Further, a substrate on which an $SiO_2$ film is laminated on a glass substrate by such as a sputtering method, a ceramic substrate such as alumina, Si substrate, or the like can be used as the substrate 1. If necessary, the substrate is fully cleaned, and then, a hydrophobic process is performed onto the surface of the substrate by using a silane coupling agent.

It is necessary that the surface of the convex portion 2 formed on the substrate 1 is made of at least an insulating material so as to prevent the conductive film 5 from short-circuiting at the gap 6. Accordingly, the convex portion 2 may be a part of the substrate 1, or may be formed by patterning an insulating material that is different from the substrate 1. An etching method, a blasting method, laser processing method, photolithography method or the like are preferably used for processing the substrate 1 and forming the convex portion 2. The convex portion 2 can be formed in such a manner that an insulating material is laminated onto the substrate 1, and patterned with a printing method or photolithography method.

Figure 3A:
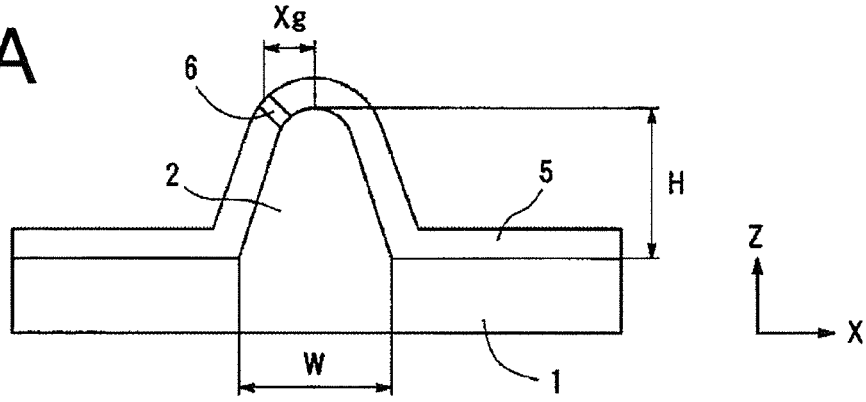
FIGS. 3A to 3C are sectional views showing an example of a shape of a convex portion of the electron-emitting device according to the present invention.
Figure 3B:
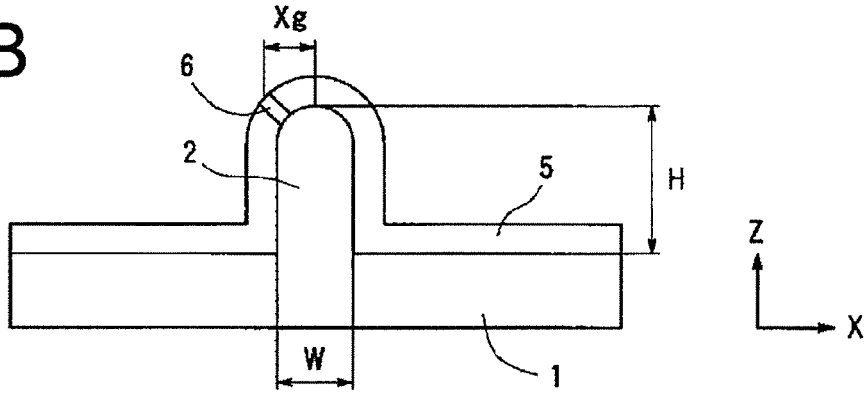
Figure 3C:
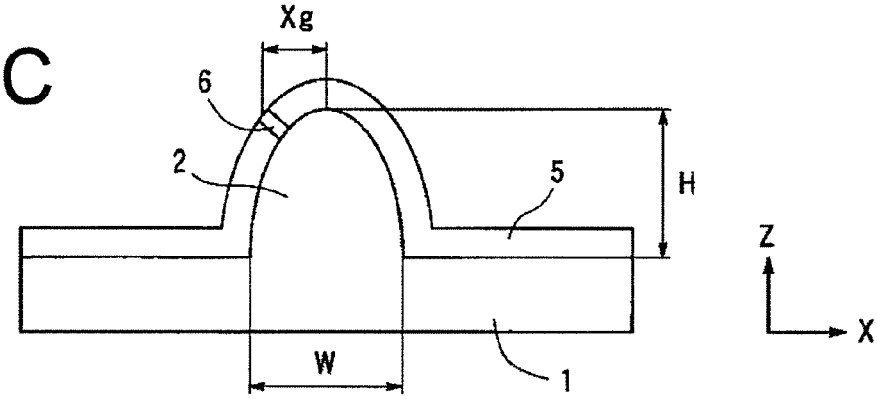
Figure 4A:
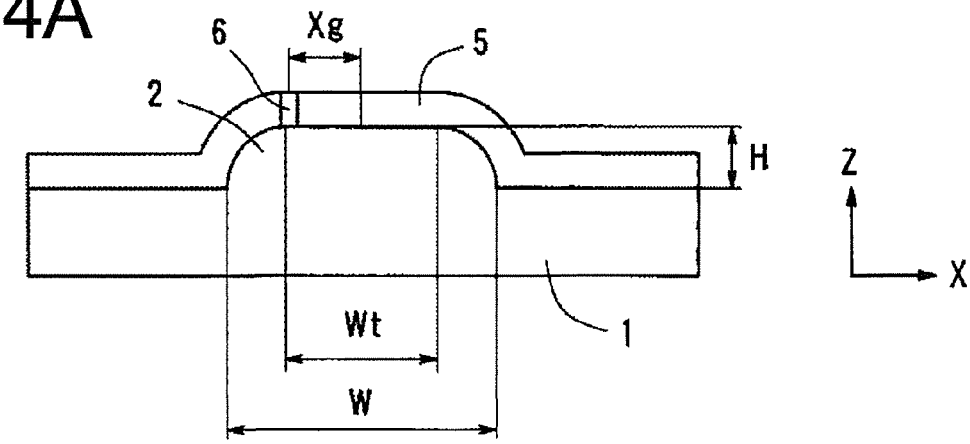
FIGS. 4A and 4B are sectional views snowing an example of a shape of a convex portion of the electron-emitting device according to the present invention.
Figure 4B:
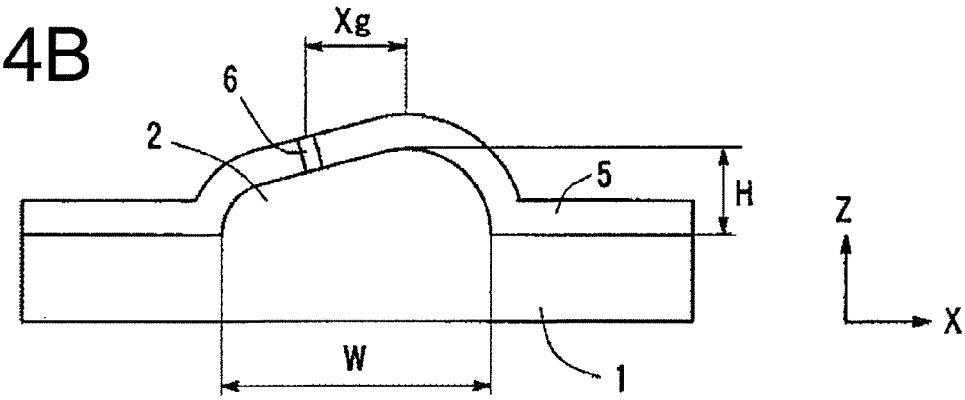

FIGS. 3 to 6 show another shape of the convex portion 2 applicable to the present invention. FIGS. 3 and 4 show the section in the X-Z plane. In the example of FIG. 1, the section is semicircular. On the other hand, in FIG. 3A, the curved portion at the top is a part of the circle, and there is a connection portion from the curved portion to the surface of the substrate 1. The connection portion and the Y-Z plane forms an acute angle. In FIG. 3B, the curved portion at the top is semicircular, and the portion below the curved portion is generally vertical to the substrate. In FIG. 3C, the sectional shape is semiellipsoidal. FIG. 4A shows the second invention, wherein a plane portion having a width Wt in the X direction is formed at the top, and the portion below the plane portion forms a part of the circle. The variation width of the height of the surface of the plane portion is not more than 5% of the height H of the convex portion 2, but the periodic fine irregularity whose radius of curvature is not more than 1/10 of the width W is not defined as the change in the height. FIG. 4B shows the first invention, wherein the shape of the section of the convex portion 2 in the X direction is asymmetric with respect to the center axis of the width W.

Figure 5A:
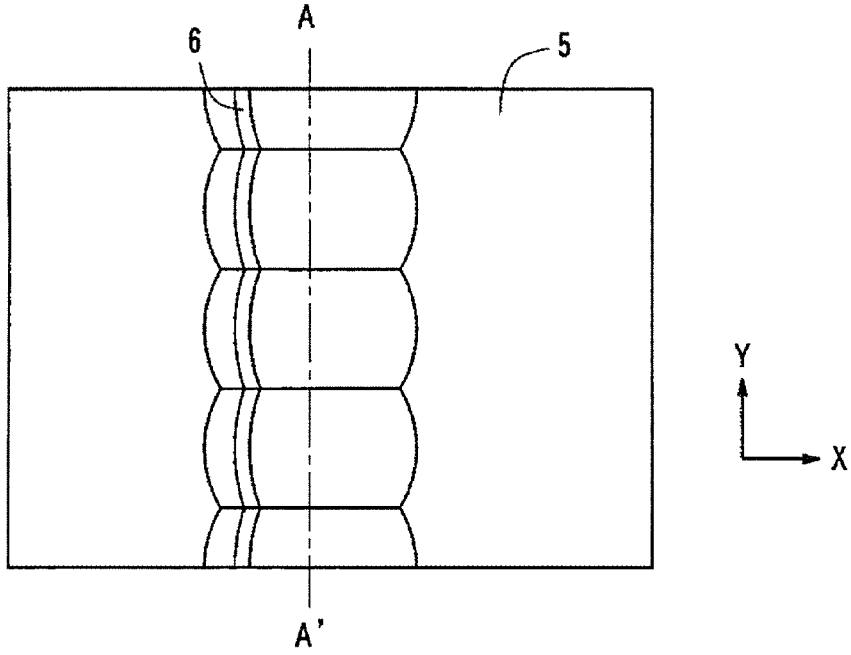
FIG. 5A is a plan view.
Figure 5B:
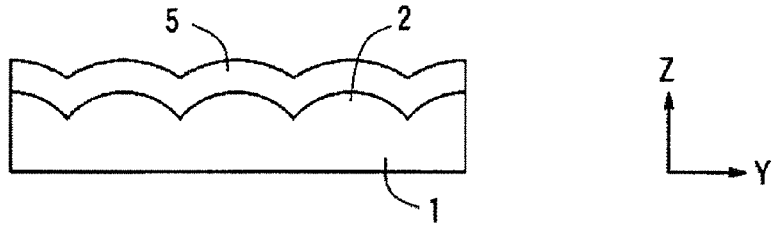
FIG. 5B is a sectional view.
Figure 6:
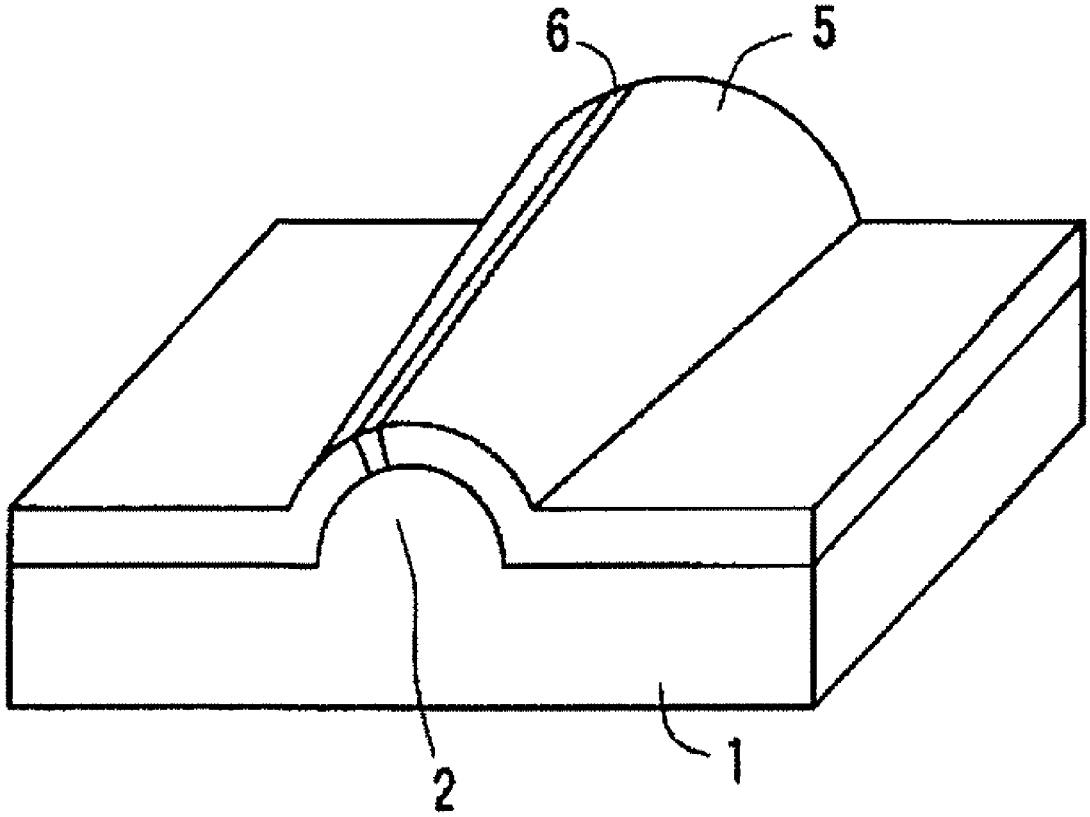
FIG. 6 is a perspective view showing an example of a shape of a convex portion of the electron-emitting device according to the present invention.

FIGS. 5 and 6 show the examples in which H, W and Xg of the convex portion 2 in the Y direction are not uniform. FIG. 5A is a plan view, FIG. 5B is a sectional view along a line A-A' in FIG. 5B, and FIG. 6 is a perspective view. The range of the variation of the width W in the X direction in the Y direction or the height H is about 50 to 200%, preferably 80 to 120%, with the average of the width W in the X direction and the height H defined as 100%.

A general conductive material can be used for the material of the electrodes 3 and 4. For example, the material of the electrodes 3 and 4 can appropriately be selected from metals such as Ni, Cr, Au, Mo, W, Pt, Ti, Al, Cu, Pd, or the like. The thickness of the electrodes 3 and 4 may be set within the range of 1 nm or more and 1 μm or less. The electrodes 3 and 4 are formed in such a manner that a constituent material of the electrodes 3 and 4 is formed on the substrate 1 with a vacuum deposition method, and the resultant is patterned by a photolithography technique.

Examples of the conductive film 5 include a metal such as Pd, Pt, Ru, Ag, Au, Ti, In, Cu, Cr, Fe, Zn, Sn, Ta, W, Pb, etc., or oxide conductor such as PdO, $SnO_2$, $In_2O_3$, PbO, $Sb_2O_3$, etc. Further, a nitride such as TiN, ZrN, HfN, etc., can be used.

It is preferable that a fine-grain film made of fine grains is used for the conductive film 5 in order to obtain satisfactory electron emission efficiency. The thickness thereof can be set within the range of 10 Å (1 nm) or more and 100 nm or less. The width of the conductive film 5 can be set within the range of 1 μm or more and 100 μm or less.

The conductive film 5 can be formed in the manner that an organic metal solvent is applied onto the substrate 1 on which the electrodes 3 and 4 are formed so as to form an organic metal film. A solution of organic compound having the material of the conductive film 5 as a main component can be used for the organic metal solvent. This organic metal film is heated and sintered, and patterned with a liftoff, etching, laser processing, or the like, so as to form the conductive film 5. Usable methods for forming the conductive film 5 include a vacuum deposition method, sputtering method, chemical vapor deposition method, dispersion and application method, dipping method, spinner method, or the like.

A so-called "forming process" is performed for forming the gap 6 on each conductive film 5. The forming process is performed by producing a potential difference between the pair of the electrodes 3 and 4 so as to energize (flow electric current to) the conductive film 5.

Specifically, when a voltage is applied between the electrodes 3 and 4, a joule heat is generated in the conductive film 5, and the gap 6 is formed on the conductive film 5. It is preferable that the voltage upon the forming process has a pulse waveform. The forming process can be ended at the time when a resistance, which is obtained by measuring the flowing current according to the application of voltage of about 0.1 [V], becomes not less than 1 [MΩ]. As shown in FIG. 2B, the gap 6 may extend in the Y direction and serpentine within the range of the width Ws in the X direction. Ws is different depending upon the forming condition of the gap 6 or the condition of the conductive film 5, but it is approximately several micrometers.

It is preferable that a so-called "activation treatment" is performed to the electron-emitting device to which the forming process is completed. The activation treatment is performed by applying a voltage in the form of a pulse between the electrodes 3 and 4 like the forming process, under the atmosphere containing gas of an organic material. By this activation treatment, a later-described device current If and emission current Ie remarkably increase. A carbon film that covers the conductive film 5 in the gap 6 and in the vicinity of the gap 6 is formed by the activation treatment. A gap that is narrower than the gap 6 is formed into the gap 6 of the carbon film, so that the electrons are emitted from this narrow gap.

Finally, it is preferable that a stabilization process is performed to the electron-emitting device obtained through the aforesaid process. The stabilization process is to exhaust and reduce unnecessary materials such as an organic material in the vacuum device.

The gap 6 is a high-resistance portion formed at a part of the conductive film 5. The gap 6 depends upon the thickness, characteristic, and material of the conductive film 5 and a later-described technique such as an energizing forming process. Conductive fine grains of which diameter is several Å (several hundred pm) to several ten nm might be present in the gap 6. The conductive fine grains contain some of or all elements constituting the conductive film 5. The gap 6 and the conductive film 5 in the vicinity of the gap 6 can contain carbon or carbon compound.

Next, an effect of enhancing the electron emission efficiency and an effect of preventing the variation in the electron emission efficiency according to the present invention will be explained. Supposing that the current flowing through the conductive film is defined as the device current If, and the current flowing from the conductive film 5 to the anode electrode 8 is defined as the emission current Ie, the electron emission efficiency is represented by Ie/If.

Firstly, a potential distribution that affects the trajectory of the electrons emitted from the electron-emitting device in a general surface conduction electron-emitting device will be explained with reference to FIG. 7. In FIG. 7, the components same as those in FIG. 1 are identified by the same numerals, and the explanation thereof is omitted. In FIG. 7, the direction along the surface of the substrate 1 is defined as X, and the direction that is vertical to the substrate 1 and directs toward the anode electrode 8 is defined as Z. A dotted line 13 in FIG. 7 shows an equivalent potential line. FIGS. 7A to D are sectional views in X-Z plane of the electron-emitting device and the anode electrode 8.

Figure 7A:
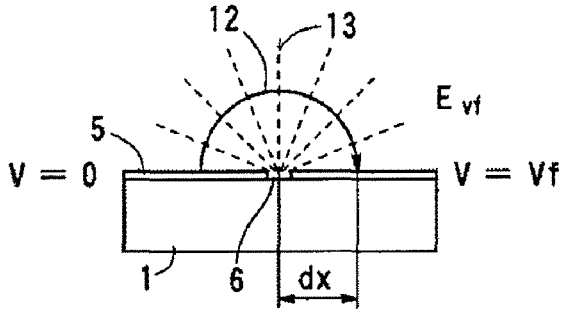
FIGS. 7A to D are explanatory views of a potential distribution that affects an trajectory of electrons emitted from the electron-emitting device.
Figure 7B:
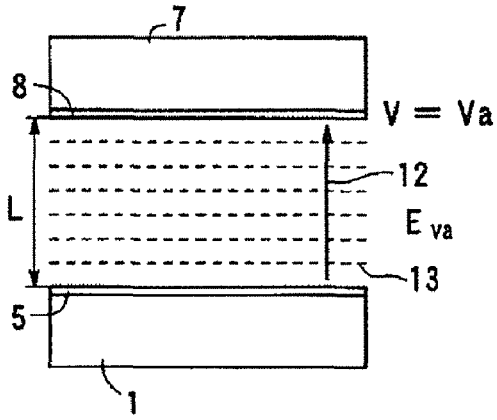
Figure 7C:
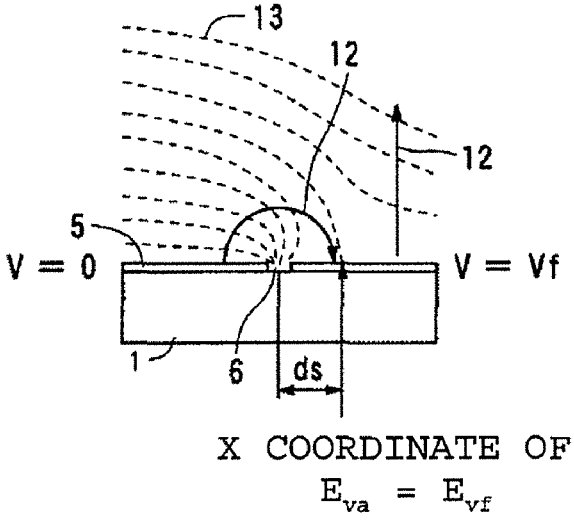

It is supposed that the voltage Vf is applied to the conductive film 5, the left end of the conductive film 5 in the figure is 0 [V], and the right end is Vf [V]. FIG. 7A shows the potential distribution in the vicinity of the gap 6 formed by the Vf when the voltage Va is not applied to the anode electrode 8. FIG. 7B shows the potential distribution when the voltage applied to the conductive film 5 is set to 0 [V], and the voltage Va is applied to the anode electrode 8. The anode electrode 8 is arranged at the position apart from the substrate 1 by the distance L. In FIG. 7A, the electrons emitted from the gap 6, which is the electron-emitting portion, receives force 12 that directs toward the substrate 1 by a rotating electric field having a magnitude of $E_{vf}=Vf/(\pi dx)$ in the Z direction at the position of X=dx, when the center of the gap 6 is defined as X=0. In FIG. 7B, the electrons on the substrate 1 receives force 12 directing toward the anode electrode 8 by the parallel electric field applied between the substrate 1 and the anode electrode 8 and having a magnitude of $E_{va}=Va/L$ in the Z direction. FIG. 7C shows a potential distribution when the anode voltage Va is applied to the anode electrode 8 and the Vf[0] is applied to the conductive film 5. The X coordinate ds where the electric field $E_{vf}$ and the electric field $E_{va}$ are equal to each other is $$ds=(Vf/\pi)\times(L/Va) \quad (1)$$

(The distance from the center of the gap 6 to this point is referred to as ds hereinafter).

The position where the electric field $E_{vf}$ and the electric field $E_{va}$ are equal to each other is generally referred to as a stagnation point. The electrons emitted beyond the stagnation point almost reach the anode electrode 8 without dropping onto the conductive film 5, and contribute to the emission current Ie. On the other hand, the electrons that cannot reach the stagnation point drop onto the conductive film 5, and scatter there at least once, whereby some of the scattered electrons reach the anode electrode 8 and contribute to the emission current Ie. It is mentioned that the electrons that can again fly into the vacuum after the scattering are 20 to 30% among the collided electrons. Therefore, if the energies of the electrons are the same, the electrons having shorter ds can reach the stagnation point with reduced number of times of the scattering, whereby the electron emission efficiency can be enhanced. It is understood from the equation (1) that the electron emission efficiency is enhanced by reducing the distance L or increasing the voltage Va, since this reduces ds.

Figure 7D:
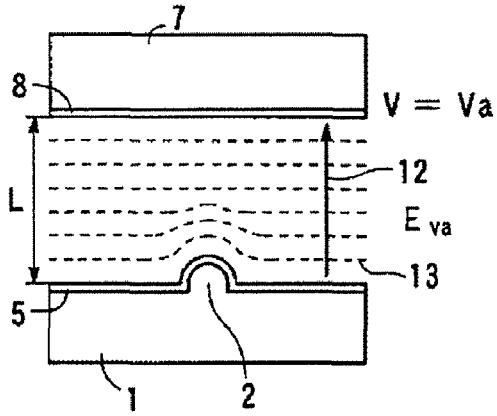

FIG. 7D shows the potential distribution when the anode voltage Va is applied to the anode electrode 8 and the semicircular convex portion 2 is formed on the substrate 1. It is supposed that the surface potential of the convex portion 2 is set to 0. As shown in the figure, the equivalent potential line is bent in the vicinity of the convex portion 2. The equivalent potential line is dense at the top of the convex portion 2 (the portion of the convex portion 2 that is the closest to the anode electrode 8). Specifically, the electric field is the strongest. The ratio β (electric field multiplication factor) of the electric field to the parallel electric field is determined by the geometrical shape of the convex portion 2. For example, when the section of the convex portion 2 is semicircular as shown in FIG. 7D, β=2. This means that the electric field at the top of the convex portion 2 doubles compared to the case in which the convex portion 2 is not formed. Therefore, when the gap 6, which serves as the electron-emitting portion, is formed at the top of the convex portion 2, the distance ds to the stagnation point is a half the distance (hereinafter referred to as $ds_0$) to the stagnation point in case where the convex portion 2 is not formed. It is experimentally known that, in an ordinary surface conduction electron-emitting device, the electron emission efficiency is in proportion to 0.5 square of Va (i.e., the electric field $E_{va}$ in the Z direction formed by Va). Accordingly, the convex portion 2 that locally doubles the electric field in the Z direction achieves about 1.4-fold ($2^{0.5}$) enhancement of the electron emission efficiency. In the above explanation, the sectional shape of the convex portion 2 is semicircular, so that the electric field multiplication coefficient β is 2. However, when H is increased with respect to W as shown in FIGS. 3A to C, the electric field multiplication coefficient β increases, so that the electron emission efficiency increases.

On the other hand, when the gap 6, which serves as the electron-emitting portion, is actually arranged at the top of the convex portion 2, the height H of the convex portion 2 and the position Xg of the gap 6 affect the electron emission efficiency. Next, the height H of the convex portion 2 and the position Xg of the gap 6 will be explained.

Figure 8A:
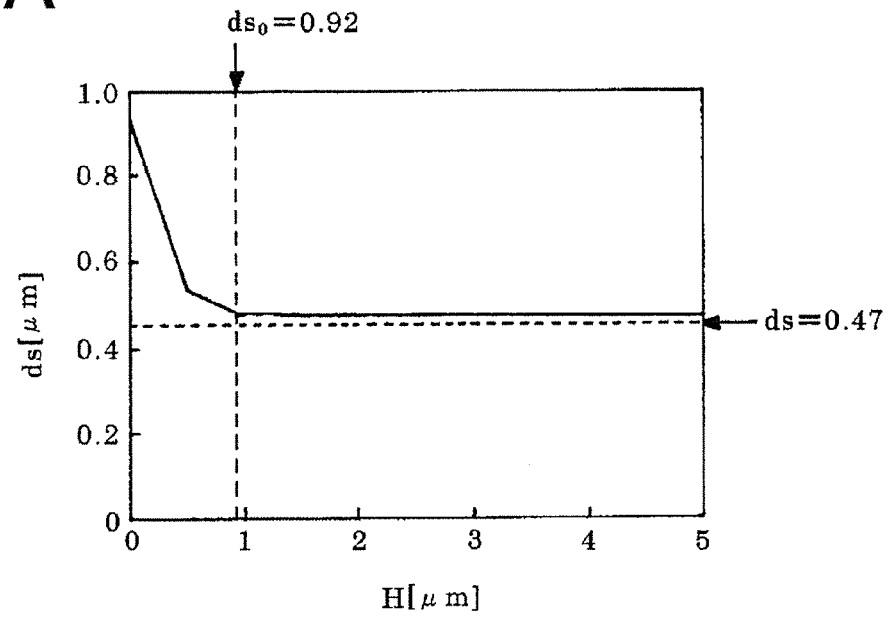
FIGS. 8A and 8B are views showing a relationship between the height of the convex portion and the distance between the gap and a stagnation point, and a relationship between the ratio of the position of the gap to the width of the convex portion and the distance between the gap and the stagnation point.

FIG. 8A shows the result of the calculation of the relationship between the height H and the distance ds from the gap 6 to the stagnation point when the gap 6 is arranged at the top of the convex portion 2 having the semicircular section in the X direction. The condition of the calculation is, for example, Va=10 kV, Vf=18 V, and L=1.6 mm upon the electron emission. The distance $ds_0$ from the gap 6 to the stagnation point when the convex portion 2 is not formed is 0.92 μm. In the case of $H\geqq ds_0$, the equation of $ds=ds_0/2=ds_0/\beta$ is established, by which it is understood that the electron emission efficiency is enhanced regardless of the height H. On the other hand, in the case of $H<ds_0$, the ds increases as the H is decreased, so that it is understood that effect of enhancing the electron emission efficiency is reduced. Thus, it is understood that, as for the height of the convex portion, $H\geqq ds_0=Vf\times L/(\pi\times Va)$ is preferable.

Figure 8B:
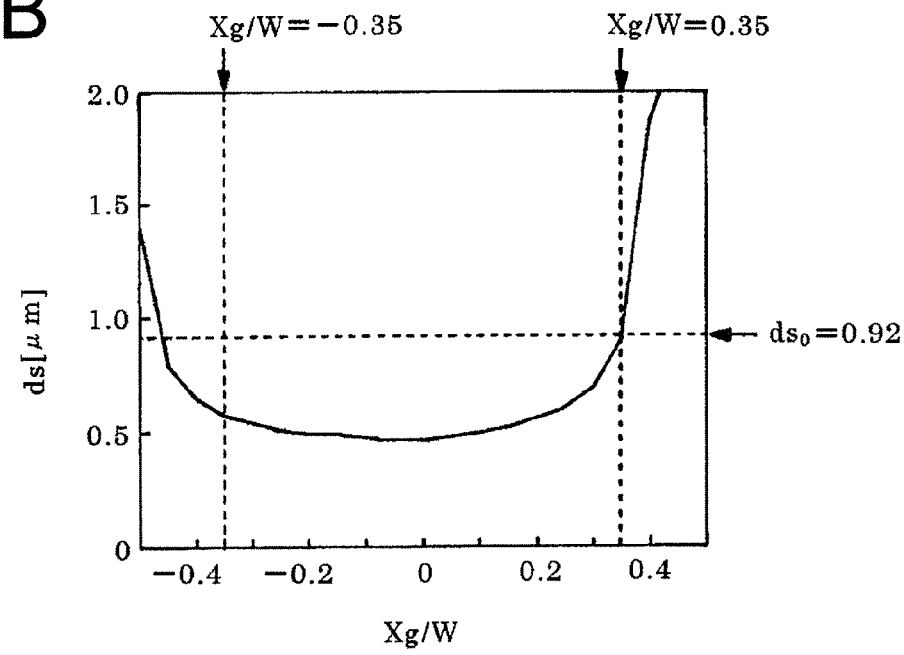

FIG. 8B shows the result of the calculation of the relationship between Xg/W and ds when the position of the gap 6 is defined as Xg and the width of the convex portion 2 having the semicircular section in the X direction is defined as W. The condition of the calculation is H=2 μm, and W=4 μm, and the other conditions are the same as those in FIG. 8A. As a result, in the case of $|Xg/W|\leqq 0.35$, the inequality of $ds\leqq ds_0$ is established, which means there is no sharp change in ds. Consequently, it is understood that the substantially equivalent electron emission efficiency is obtained within this range.

On the other hand, in the case of $|Xg/W|>0.35$, the inequality of $ds>ds_0$ is established, which means that the electron emission efficiency is reduced compared to the case in which the convex portion 2 is not formed. Further, it is understood that the electron emission efficiency greatly changes due to the value of Xg/W. Thus, it is understood that $|Xg|\leqq 0.35$ W is preferable for the position Xg of the gap 6 in order to stably enhance the electron emission efficiency. This relationship is applicable to FIGS. 1, 3A, B, C, and 4B in which the top of the convex portion 2 has a curved portion projecting outwardly.

In the case of the surface conduction electron-emitting device taken as an example, it has been found that the gap 6, which serves as the electron-emitting portion, might serpentine depending upon the fabrication condition or the condition of the conductive film as shown by the enlarged view of FIG. 2B. In the electron-emitting device according to the present invention, the electron emission efficiency hardly changes even if the position Xg of the gap 6 varies within the range of $|Xg|\leqq 0.35$ W. Therefore, the variation of the electron emission efficiency is reduced if the range of the serpentine is within this range.

The similar operation and effect can be obtained even if a part of the top is plane over the width Wt as shown in FIG. 4A. Although the condition for the height H of the convex portion 2 is unchanged, the inequality of $|Xg|\leqq 0.35$ W+0.15 Wt is preferable for the position Xg of the gap 6. It is to be noted that, when the width Wt of the plane portion is too large, the electric field multiplication effect at the convex portion 2 is reduced. Therefore, the range of $Wt\leqq 0.2$ W is practically preferable.

As for the radius of curvature R of the curved portion of the top, the variation in the electron emission efficiency due to the positional deviation of the gap becomes small as the R increases. Specifically, it has been found that the effect of the present invention can more stably be obtained in the case of R≧0.5 W. In the present embodiment, the explanation about the convex portion 2 is made only with the sectional view. However, since the sectional shape is continuous in the Y direction, the effect of the present invention can be obtained over the whole length of the convex portion 2. Particularly, when the sectional shape varies along the Y direction as shown in FIGS. 5 and 6, the length of the gap 6, which serves as the electron-emitting portion, becomes longer than the length of the gap whose sectional plane is continuous as shown in FIG. 1. Therefore, the additional effect such as the increase in the device current or the reduction in fluctuation, or the like can be provided.

In the present invention, an image display apparatus can be configured such that aforesaid plural electron-emitting devices are arranged on the same substrate, and an anode electrode is arranged at the position opposite to the substrate. More specifically, plural electron-emitting devices according to the present invention are arranged on the same substrate, and wirings for applying a voltage to each electrode are mounted to form a rear plate (first substrate). On the other hand, an image forming member such as a phosphor film is formed on a transparent insulating substrate such as a glass substrate, and an anode electrode serving as a metal back is formed thereon by vapor deposition of such as Al. The resultant is defined as a face plate (second substrate). The rear plate and the face plate are arranged so as to be opposite to each other in such a manner that the anode electrode and the electron-emitting devices are opposite to each other with a predetermined distance. The surrounding is sealed, whereby an image display apparatus can be manufactured. Electrons are emitted from each electron-emitting device by applying a drive voltage through the wirings. The emitted electrons are accelerated by the voltage Va between the anode electrode and the conductive film, and collide with the image forming member (phosphor film). Thus, the image forming member emits light, whereby a desired image is formed.

The present invention will be explained in more detail with reference to the specific examples.

Example 1

[Formation of Convex Portion]

In this Example, a glass was used as the substrate 1, and an $SiO_2$ film with a thickness of 2 μm was applied thereon. Then, resist was applied and patterned. Subsequently, the region other than the region where the convex portion 5 was formed was removed by etching so as to form the convex portion 2. The convex portion 2 had the semicircular sectional shape in the X direction as shown in FIG. 1, wherein the height H of the top was 2 μm, the width W of the convex portion 2 was 4 μm, and the radius of curvature R of the curved portion was 2 μm. The semi-cylindrical convex portion 2 in which the aforesaid shape extended in the Y direction was formed.

[Formation of Electrode]

A Pt film with a thickness of 20 nm was formed on the glass substrate by a sputtering method so as to form the electrodes 3 and 4. The space between the electrodes 3 and 4 was set to 10 μm.

[Formation of Conductive Film and Electron-Emitting Portion]

After the substrate was well cleaned, a palladium oxide (PdO) film with a thickness of 10 nm at the maximum was obtained. Then, the palladium oxide was reduced under the vacuum atmosphere containing a hydrogen gas to form a conductive film 5 made of palladium. Next, the conductive film 5 was energized and heated, whereby a first gap was formed at a part of the conductive film 5. The gap was formed at substantially the center of the conductive film 5, and somewhat serpentined, but the serpentine width Ws was not more than 2 μm. The center of the serpentine was substantially the center of the width of the convex portion 2 (Xg=0).

Subsequently, tolunitrile was introduced into the vacuum atmosphere, and the energizing process was performed to the conductive film 5 under the vacuum atmosphere of $1.3\times10^{-4}$ Pa. Thus, a carbon or carbon compound was deposited in the vicinity of the first gap to form a second gap (gap 6).

[Arrangement of Anode Substrate]

The substrate 1 (hereinafter referred to as rear plate) thus obtained and the face plate having the anode electrode 8 formed on the glass substrate were arranged in the vacuum such that the distance L between the substrate 1 and the anode electrode 8 became 1.6 mm.

Example 2

As shown in FIG. 4A, the electrodes 3 and 4 were formed in the same manner as in the example 1 except that a part of the top of the convex portion 2 in the section of X direction was plane. The height H of the top was 2 μm, the width W of the convex portion 2 was 5 μm, and the width Wt of the plane portion of the top was 1 μm. The convex portion 2 had the shape in which this sectional shape extended in the Y direction.

Next, a palladium oxide film was formed in the same manner as in the Example 1. Then, in this Example, the palladium oxide film was energized and heated under the vacuum atmosphere containing a slight amount of hydrogen gas in order to reduce electric power upon the energization for forming the first gap. Thus, the palladium oxide was reduced to form the conductive film 5 made of palladium, and simultaneously, the gap 6 was formed at a part of the conductive film 5. The formed gap 6 had the width larger than the gap 6 in the Example 1, and its serpentine width Wm was about 3.5 μm. The center of the serpentine was substantially at the center of the width of the convex portion 2 (Xg=0).

Example 3

The rear plate was formed in the same manner as in the Example 1 except that the convex portion 2 had a sectional shape in the X direction having a semicircular shape laminated on a rectangle as shown in FIG. 3B. The height H of the top of the convex portion 2 was 4 μm, the width W of the convex portion 2 was 4 μm, and the radius of curvature R of the top of the convex portion was 2 μm. The convex portion 2 had the shape in which this sectional shape extended in the Y direction.

When the gap 6 serving as the electron-emitting portion was formed, the conductive film 5 made of the reduced palladium was heated and energized to form the gap 6 like the Example 1. The formed gap 6 serpentined with the serpentine width Ws of about 2 μm that was approximately the same as that in the Example 1. The center of the serpentine was substantially at the center of the width of the convex portion 2 (Xg=0).

Example 4

The rear plate was formed in the same manner as in the Example 1 except that the convex portion 2 was formed whose height H and the width W varied at a predetermined cycle in the Y direction as shown in FIG. 5. The height H of the convex portion 2 was 2 to 4 μm in which the average Hav was about 3 μm, the width W was 2 to 4 μm in which the average Wav was about 3 μm, and the radius of curvature R at the top of the convex portion 2 was 2 to 4 μm in which the average Rav was about 3 μm.

When the gap 6 serving as the electron-emitting portion was formed, the conductive film 5 made of the reduced palladium was heated and energized to form the gap 6 like the Example 1. The formed gap 6 serpentined with the serpentine width Ws of about 2 μm that was approximately the same as that in the Example 1. The center of the serpentine was substantially at the center of the width of the convex portion 2 (Xg=0).

Comparative Example 1

The rear plate was formed in the same manner as in the Example 1 except that the substrate 1 did not have the convex portion 2, and the surface thereof was flat. The gap 6, serving as the electron-emitting device, serpentined with the serpentine width Ws of about 2 μm that was approximately the same as that in the Example 1. The center of the serpentine was substantially at the center of the conductive film 5.

Comparative Example 2

The rear plate was formed in the same manner as in the Example 1 except that section of the convex portion 2 in the X direction was in the shape of substantially an isosceles triangle. The height H of the convex portion 2 was 2 μm, the width W thereof was 4 μm, and the radius of curvature at the top was 0.2 μm. The convex portion 2 had a shape of a triangle pole in which the sectional shape was continuous in the Y direction. The gap 6 serving as the electron-emitting portion serpentined with the serpentine width Ws of about 1 μm about the top. The central position of the serpentine was substantially at the center of the width of the convex portion 2 (Xg=0).

Comparative Example 3

The rear plate was formed in the same manner as in the Example 1 except that the convex portion 2 was formed into a semi-cylindrical shape such that the section thereof in the X direction was semicircular having the height H of 0.2 μm, the width W of 0.4 μm and the radius of curvature at the top of 0.2 μm, and this sectional shape extended in the Y direction. The formed gap 6 serving as the electron-emitting portion serpentined with the serpentine width Ws of about 2 μm that was approximately the same as that in the Example 1. The center of the serpentine was substantially at the center of the width of the convex portion 2 (Xg=0).

[Evaluation]

Voltage was applied to the devices obtained by the Examples 1 to 4 and the Comparative Examples 1 to 3 in such a manner that the electrode 3 had 0 V, the electrode 4 had 18 V, and the anode electrode 8 had 10 kV. As a result, it was confirmed that electric current flew through the anode electrode 8, and the electrons were emitted.

In order to confirm the effect of the present invention, the electron emission efficiency, which was obtained as the ratio of the device current If flowing between the electrodes 3 and 4 and the emission current Ie detected at the anode electrode 8, was measured for plural substrates. Table 1 shows the result.

TABLE 1

| | Electron emission efficiency (Comparative Example 1 is defined as 1) | H [μm] | W [μm] | Sectional shape of convex portion | Distance of serpentine from center of conductive film | Variation (Comparison with Comparative Example 1) |
|---|---|---|---|---|---|---|
| Example 1 | 1.3-1.4 | 2 | 4 | FIG. 1 | 1 μm (<0.35 W = 1.4 μm) | Same level |
| Example 2 | 1.3-1.4 | 2 | 5 | FIG. 4(a) | 1.75 μm (<0.35 W + 0.15 Wt = 1.9 μm) | Same level |
| Example 3 | 1.6-1.8 | 4 | 4 | FIG. 3(b) | 1 μm (<0.35 W = 1.4 μm) | Same level |
| Example 4 | 1.5-1.6 | 2-4 | 2-4 | FIG. 5 | 1 μm (<0.35 W = 1.4 μm) | Same level |
| Comparative Example 1 | 1 | — | — | — | — | — |
| Comparative Example 2 | 0.7-2.0 | 2 | 4 | Isosceles triangle | 1 μm (<0.35 W = 1.4 μm) | Increase |
| Comparative Example 3 | 1 | 0.2 | 0.4 | FIG. 1 | 1 μm (<0.35 W = 0.14 μm) | Same level |

In the case of Example 1, the electric field multiplication effect by the convex portion 2 effectively acts, so that the electron emission efficiency increases compared to the Comparative Example 1. Further, although the gap 6 serpentines, it is within the distance of 0.35 W from the top of the convex portion 2, whereby the variation in the electron emission efficiency is the same as that in the Comparative Example 1. In the case of Example 2, the electron emission efficiency and the variation in the electron emission efficiency are the same level in the Example 1, although the serpentine width Ws of the gap 6 in the Example 2 is larger than that in the Example 1.

In the case of Examples 3 and 4, the electron emission efficiency increases more than the Example 1, since the electric field multiplication efficiency of the convex portion 2 is greater than that in the Example 1. Further, although the gap 6 serpentines, it is within the distance of 0.35 W from the top of the convex portion 2, whereby the variation in the electron emission efficiency is the same as that in the Comparative Example.

In the Comparative Example 2, the electron emission efficiency increases from 0.7-fold to two-fold in the Comparative Example 1, which means the electron emission efficiency greatly varies. This is considered that, since the radius of curvature of the top of the convex portion 2 is small such as 0.1 W, which means that the convex portion 2 does not substantially have the curved portion, the electron emission efficiency greatly varies due to the serpentine of the gap 6, compared to the case in which the radius of curvature R at the top of the convex portion 2 is not less than 0.5 W like the Examples 1 to 4.

In the Comparative Example 3, the electron emission efficiency is the same level as that in the Comparative Example 1 although the convex portion 2 is formed. This is considered that a sufficient electric field multiplication effect cannot be obtained since the height H of the convex portion 2 is about $ds_0/10$.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-242109, filed on Sep. 19, 2007, which is hereby incorporated by reference herein its entirety.

What is claimed is:

1. An electron-emitting device comprising:

a substantially linear convex portion forming a projection on a substrate; a first electrode and a second electrode formed on the substrate across the convex portion; a conductive film that connects the first electrode and the second electrode; and an electron-emitting portion that is composed of a gap formed on the conductive film and is present on the convex portion, wherein, supposing that a direction in which the convex portion extends is defined as a Y direction, a direction orthogonal to the Y direction on the substrate is defined as an X direction, and a normal direction of the substrate is defined as a Z direction, a top portion of the convex portion in X-Z section has a curved portion having a convex shape toward the projecting direction of the convex portion, and supposing that a voltage applied between the first electrode and the second electrode upon a electron emission is defined as Vf, a distance between an anode electrode, which is opposite to the substrate, and the substrate is defined as L, a voltage applied between the substrate and the anode electrode is defined as Va, a height from a surface of the substrate to the top of the convex portion is defined as H, a width of the convex portion at a bottom surface in the X direction is defined as W, and a distance between a center of the gap in the X direction and the top of the convex portion is defined as Xg, $$H \geqq (Vf \times L)/(\pi \times Va)$$

$$|Xg| \leqq 0.35\ W$$

are established, wherein a shape of the convex portion in the X-Z section changes along the Y direction.

2. An electron-emitting device according to claim 1, wherein a radius of curvature of the curved portion at the top is not less than 0.5 W.

3. An image display apparatus comprising:

a first substrate having a plurality of electron-emitting devices according to claim 1; and a second substrate including an anode electrode that is opposite to the first substrate and an image forming member that emits light by the electrons emitted from the electron-emitting devices.

4. An electron-emitting device comprising:

a substantially linear convex portion forming a projection on a substrate; a first electrode and a second electrode formed on the substrate across the convex portion; a conductive film that connects the first electrode and the second electrode; and an electron-emitting portion that is composed of a gap formed on the conductive film and is present on the convex portion, wherein, supposing that a direction in which the convex portion extends is defined as a Y direction, a direction orthogonal to the Y direction on the substrate is defined as an X direction, and a normal direction of the substrate is defined as a Z direction, a top portion of the convex portion in X-Z section has a plane portion whose width in the X direction is Wt, and a curved portion that is in contact with the plane portion and projects outwardly, and supposing that a voltage applied between the first electrode and the second electrode upon the electron emission is defined as Vf, a distance between an anode electrode, which is opposite to the substrate, and the substrate is defined as L, a voltage applied between the substrate and the anode electrode is defined as Va, a height from a surface of the substrate to the top of the convex portion is defined as H, a width of the convex portion at a bottom surface in the X direction is defined as W, and a distance between a center of the gap in the X direction and the top of the convex portion is defined as Xg, $$H \geqq (Vf \times L)/(\pi \times Va)$$

$$|Xg| \leqq 0.35\ W + 0.14\ Wt$$

are established, wherein a shape of the convex portion in the X-Z section changes along the Y direction.

5. An image display apparatus comprising:

a first substrate having a plurality of electron-emitting devices according to claim 4; and a second substrate including an anode electrode that is opposite to the first substrate and an image forming member that emits light by the electrons emitted from the electron-emitting devices.

* * * * *